US005611293A

United States Patent [19]

Mitsui et al.

[11] Patent Number: 5,611,293

[45] Date of Patent: Mar. 18, 1997

[54] SEWING MACHINE

[75] Inventors: Hiroyuki Mitsui, Kasugai; Shiro Oya, Nagoya; Etuzo Nomura, Kasugai; Yuji Tagawa, Nagoya; Yoichi Kurahashi, Owariasahi, all of Japan

[73] Assignee: Brother Kogyo Kabushiki Kaisha, Nagoya, Japan

[21] Appl. No.: 523,139

[22] Filed: Sep. 5, 1995

[30] Foreign Application Priority Data

Sep. 20, 1994 [JP] Japan ..... 6-225036

[51] Int. Cl.[6] ..... D05B 21/00

[52] U.S. Cl. ..... 112/470.18

[58] Field of Search ..... 112/470.14, 470.18, 112/470.01, 470.06

[56] References Cited

U.S. PATENT DOCUMENTS 4,103,632 8/1978 Bowles .
4,131,075 12/1978 Wurst .
4,167,912 9/1979 Sedlatschek et al. .
4,176,561 12/1979 Davidson .
4,391,211 7/1983 Yamamoto et al. .
4,455,956 6/1984 Yamamoto et al. .
4,563,960 1/1986 Albrecht ..... 112/470.18
4,602,578 7/1986 Yokoe et al. ..... 112/470.18
5,018,462 5/1991 Brocklehurst ..... 112/470.18

*Primary Examiner*—Paul C. Lewis
*Attorney, Agent, or Firm*—Oliff & Berridge

[57] ABSTRACT

A sewing machine including a needle holding device which holds a sewing needle, a sheet holding device which holds one or more work sheets, and a moving device which moves the sheet holding device relative to the needle holding device, the moving device including a drive source which produces a drive force, one or more cylindrical cams which are connected to the drive source and each of which is rotatable about an axis line by being driven by the drive source, each cylindrical cam having a pair of opposite spiral cam surfaces formed on an outer circumferential surface thereof, and one or more cam followers which are connected to the sheet holding device and each of which is engaged with the spiral cam surfaces of a corresponding cylindrical cam such that the cam follower is movable along the cam surfaces and is substantially immovable in directions perpendicular to the cam surfaces, the cam follower being moved in a drive-force transmitting direction substantially parallel to the axis line of the cylindrical cam when the cam is rotated by the drive source, so that the cam follower transmits the drive force of the drive source to the sheet holding device.

18 Claims, 5 Drawing Sheets

SEWING MACHINE

BACKGROUND OF THE INVENTION

1. Field of the Invention

The present invention relates to a sewing machine including a sheet holding device for holding one or more work sheets and a moving device for moving the sheet holding device, and thereby moving the work sheet or sheets, relative to a sewing needle.

2. Related Art Statement

U.S. Pat. No. 4,455,956 discloses a sewing machine including (a) a pair of electric motors which are provided under a sewing bed such that respective drive shafts of the motors extend perpendicular to a top surface of the bed, (b) a pair of sector spur gears which are engaged with respective pinion gears fixed to the drive shafts of the motors, (c) a first group of levers which cooperate with each other to move a feed plate (i.e., sheet holding device) in a first direction (i.e., X direction) parallel to the top surface of the bed, according to the rotation of one of the spur gears, and (d) a second group of levers which cooperate with each other to move the feed plate in a second direction (i.e., Y direction) parallel to the top surface of the bed, according to the rotation of the other spur gear.

In the above sewing machine, the feed plate is movable to any desired position on an X-Y plane defined by the X and Y directions, when one or both of the two motors is/are driven by an appropriate angular amount or amounts.

However, the transmitting mechanism for transmitting the drive forces of the motors to the sheet holding device (i.e., feed plate), including the spur gears and the first and second groups of levers, suffers from small reduction gear ratio. Therefore, the moving device for moving the sheet holding device needs a motor or motors which can output a high power or torque. However, the high-power motors have a large size and cost high.

On the other hand, if a drive-force transmitting mechanism including a plurality of steps each for increasing the reduction gear ratio is employed as part of the moving device, then the moving device suffers from increased inertia thereof. When the moving device is started to move the sheet holding device, is stopped, or is direction-changed, the inertias of the sheet holding device and the moving device react on the motors, thereby adversely changing the rotation amounts of the motors. For avoiding this, the moving device needs expensive high-power motors that, however, occupy a large space under the sewing bed where it is difficult to provide a wide space. The reacting motion of the sheet holding device transmitted backward to the motors is directly proportional to the square of the moving speed of the sheet holding device or feed plate. Thus, in the prior sewing machine, the moving device could not move the feed plate at high speed and accordingly could not effectively follow the high rotation speed of the needle-driving motor.

Japanese Patent Application laid open for opposition under Publication No. 60-17548 discloses a sewing machine including a belt and a pulley for moving a feed plate. In this sewing machine, too, the motion of the feed plate is adversely transmitted to the output shaft of a drive motor via the belt and the pulley. Thus, the second sewing machine suffer from the same problems as described above with the first sewing machine.

SUMMARY OF THE INVENTION

It is therefore a first object of the present invention to provide a sewing machine which enjoys a great reduction speed ratio without increasing the inertia of a moving device for moving a sheet holding device.

It is a second object of the present invention to provide a sewing machine which does not transmit the motion of a sheet holding device to a drive source.

The above first object has been achieved according to a first aspect of the present invention, which provides a sewing machine comprising a needle holding device which holds a sewing needle, a sheet holding device which holds at least one work sheet, and a moving device which moves the sheet holding device relative to the needle holding device, the moving device including a drive source which produces a drive force, at least one cylindrical cam which is connected to the drive source and is rotatable about an axis line by being driven by the drive source, the cylindrical cam having a pair of opposite spiral cam surfaces formed on an outer circumferential surface thereof, and at least one cam follower which is connected to the sheet holding device and is engaged with the spiral cam surfaces of the cylindrical cam such that the cam follower is movable along the cam surfaces and is substantially immovable in directions perpendicular to the cam surfaces, the cam follower being moved in a drive-force transmitting direction substantially parallel to the axis line of the cylindrical cam when the cam is rotated by the drive source, so that the cam follower transmits the drive force of the drive source to the sheet holding device.

In the sewing machine constructed as described above, the combination of the cylindrical cam and the cam follower provides a great reduction speed ratio when transmitting the drive force of the drive source connected to the cam, to the sheet holding device connected to the cam follower. In addition, since the cylindrical cam and the cam follower are very simple, the inertia of them is very low. Thus, the present sewing machine need not employ a high-power motor or motors that occupy a large space under a sewing bed of the machine and increase the production cost of the machine.

In a preferred embodiment according to the first aspect of the invention, the cylindrical cam has a spiral groove which has a pair of opposite side-wall surfaces as the pair of opposite spiral cam surfaces and has a constant width over an entire length of the side-wall surfaces, and the cam follower comprises a single roller which is rotatable about an axis line and is engaged with the spiral groove of said cam. Since the cylindrical cam having the spiral groove and the single holler are very simple, the production cost of the sewing machine is reduced as such. In addition, substantially no friction is produced when the cam follower is moved relative to the cylindrical cam. Therefore, the durability of the sewing machine is increased and the accuracy of movement of the sheet holding device is improved.

In another embodiment according to the first aspect of the invention, the cylindrical cam has a spiral ridge which has a pair of opposite side surfaces as the pair of opposite spiral cam surfaces and has a constant width over an entire length of the side surfaces, and the cam follower comprises a pair of rollers each of which is rotatable about an axis line and which are engaged with the spiral ridge of the cam. The two rollers may be biased by a biasing device, so as to pinch the spiral ridge. In the latter case, the width of the spiral ridge may not be constant over the entire length of the side surfaces.

In another embodiment according to the first aspect of the invention, the cylindrical cam has a spiral groove which has a pair of opposite side-wall surfaces as the pair of opposite spiral cam surfaces and has a constant width over an entire length of the side-wall surfaces, and the cam follower comprises a single block having a pair of opposite side surfaces which are held in slideable contact with the two side-wall surfaces of the spiral groove, respectively, and have a predetermined friction coefficient. The friction coefficient of the block member may be predetermined such that any motion of the sheet holding device is not transmitted to the drive source, i.e., does not cause the block member to rotate the cylindrical cam.

In another embodiment according to the first aspect of the invention, the sewing machine further comprises a sewing bed, the at least one cam comprises a first and a second cam, the at least one cam follower comprises a first and a second cam follower which are engaged with the first and second cams, respectively, and the drive source comprises a first and a second motor having a first and a second drive shaft, respectively, each of which is rotatable to produce the drive force and to which the first and second cams are coaxially connected, respectively, the first motor, the first cam, and the first cam follower cooperating with one another to move the sheet holding device in a first direction parallel to a surface of the sewing bed, the second motor, the second cam, and the second cam follower cooperating with one another to move the sheet holding device in a second direction parallel to the surface of the sewing bed and perpendicular to the first direction, the first and second drive shafts of the first and second motors extending parallel to the surface of the sewing bed. Since the two motors are provided such that the two drive shafts thereof extend parallel to the surface of the sewing bed, the two motors occupy only a flat space in the housing of the sewing machine, e.g., in a space under the sewing bed. This is very advantageous for improving the operability of the sewing machine. In this respect, it is most preferred that the first and second motors have the first and second drive shafts extending parallel to each other.

In another embodiment according to the first aspect of the invention, the sheet holding device comprises a holder member which holds the work sheet, the at least one cam comprises a first and a second cam, and the at least one cam follower comprises a first and a second cam follower, and the moving device further comprises a feed member which feeds the holder member in a first and a second direction substantially perpendicular to each other, a first lever which is rotatable about a first vertical axis line and is connected to a first portion of the feed member such that the first lever is rotatable relative to the feed member about the first axis line thereof, the first lever extending substantially parallel to the second direction, the first cam follower being connected to the first lever so that when the first cam is rotated the feed member is moved in the first direction, and a second lever which is rotatable about a second vertical axis line and is connected to a second portion of the feed member remote from the first portion thereof, such that the second lever is rotatable relative to the feed member about the second axis line thereof, the second lever extending substantially parallel to the first direction, the second cam follower being connected to the second lever so that when the second cam is rotated the feed member is moved in the second direction. The first lever may comprise a linear lever including three different portions one of which is rotatable about the first axis line of the first lever and two of which are connected to the first portion of the feed member and the first cam follower, respectively, and the second lever may comprise an L-shaped lever having three different portions an intermediate one of which is rotatable about the second axis line of the second lever and two of which are connected to the second portion of the feed member and the second cam follower, respectively, the drive device comprising a first and a second motor having a first and a second drive shaft, respectively, which extend parallel to each other and parallel to a horizontal surface of a sewing bed, the first and second cams being coaxially connected to the first and second drive shafts of the first and second motors, respectively.

The above second object has been achieved according to a second aspect of the present invention, which provides a sewing machine comprising a needle holding device which holds a sewing needle, a sheet holding device which holds at least one work sheet, and a moving device which moves the sheet holding device relative to the needle holding device, the moving device including a drive source which produces a drive force, and a one-way transmitting mechanism which transmits the drive force of the drive source to the sheet holding device and does not transmit a motion of the sheet holding device to the drive source.

In the sewing machine constructed as described above, the one-way transmitting mechanism transmits the drive force of the drive source to the sheet holding device but does not transmit the motion of the sheet holding device to the drive source. Thus, the moving device moves the sheet holding device based on the drive force of the drive source, but the motion of the sheet holding device does not react on the drive source. Therefore, in the present sewing machine, the sheet holding device can be started, stopped, and direction-changed with accuracy, and can be moved at high speed, without employing a high-power motor or motors.

In a preferred embodiment according to the second aspect of the invention, the sewing machine further comprises a sewing bed, and the moving device moves the sheet holding device in a direction parallel to a surface of the sewing bed.

In another embodiment according to the second aspect of the invention, the sewing machine further comprises a sewing bed, and the drive source comprises a motor having a drive shaft extending parallel to a surface of the sewing bed.

In another embodiment according to the second aspect of the invention, the drive source comprises a drive shaft which is rotatable to produce the drive force, and the one-way transmitting mechanism comprises at least one driving member fixed to the drive shaft of the drive source so that the driving member is rotatable with the drive shaft, at least one driven member which is engaged with the driving member such that the driving and driven members are movable relative to each other in a transmitting direction substantially parallel to the drive shaft of the drive source, and a movement transmitting device which transmits the movement of the driven member relative to the driving member in the transmitting direction, to the sheet holding device. The drive shaft may be parallel to the surface of the sewing bed. In this embodiment, if the motion of the sheet holding device is transmitted to the driven member via the movement transmitting device, that motion is not transmitted to the driving member, i.e., does not rotate the driving member. The driving member may comprise one of a spiral groove and at least one projection engaged with the spiral groove, and the driven member may comprise the other of the spiral groove and the projection. Since the spiral groove and the projection are very simple, the production cost of the transmitting mechanism is reduced.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
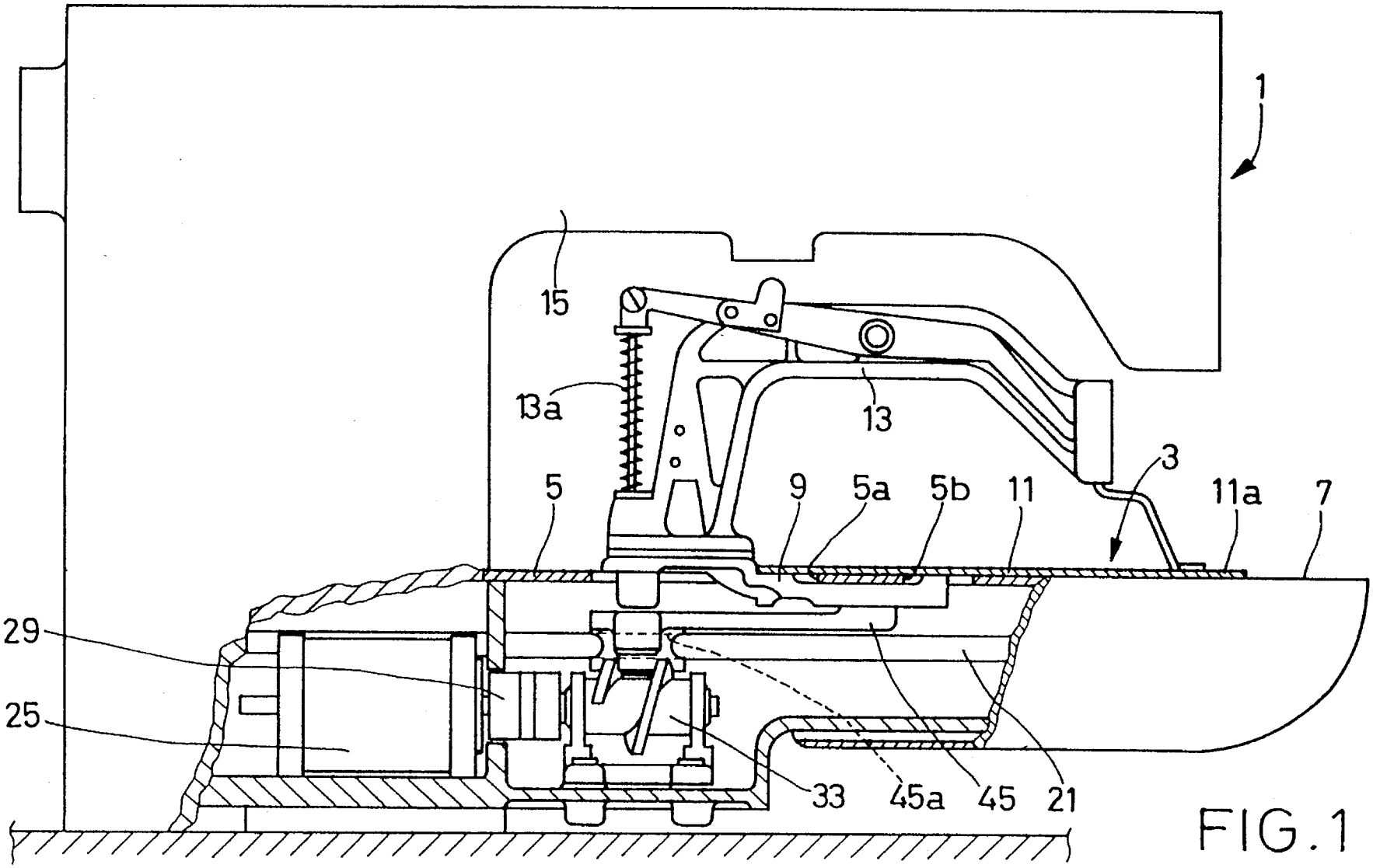
FIG. 1 is a partly-cut elevation view of a sewing machine embodying the present invention.

Referring first to FIG. 1, there is shown a sewing machine 1 to which the present invention is applied.

As shown in FIG. 1, a cover plate 5 and a throat plate 7 cooperate with each other to provide a top surface of a sewing bed 3. The cover plate 5 has two holes 5*a*, 5*b* formed through the thickness thereof. The throat plate 7 has a needle throat 7*a* (FIG. 2) formed through the thickness thereof. Under the cover plate 5, there is provided a feed table 9. Above the cover plate 5, there is provided a feed plate 11 which is fixed to the feed table 9 via the holes 5*a*, 5*b* formed through the cover plate 5. The feed plate 11 has a quadrangular frame 11*a* at a free end thereof. The feed table 9 has a pressing arm 13 which extends horizontally between a sewing arm 15 and the sewing bed 3 and which presses one or more work sheets (not shown) placed on the frame 11*a* because of a biasing force of a spring 13*a*. Thus, the work sheet or sheets held between the frame 11*a* and the pressing arm 13 is movable within a predetermined range defined by the areas of the holes 5*a*, 5*b*, along a top surface of the cover plate 5 or sewing bed 3.

Figure 2:
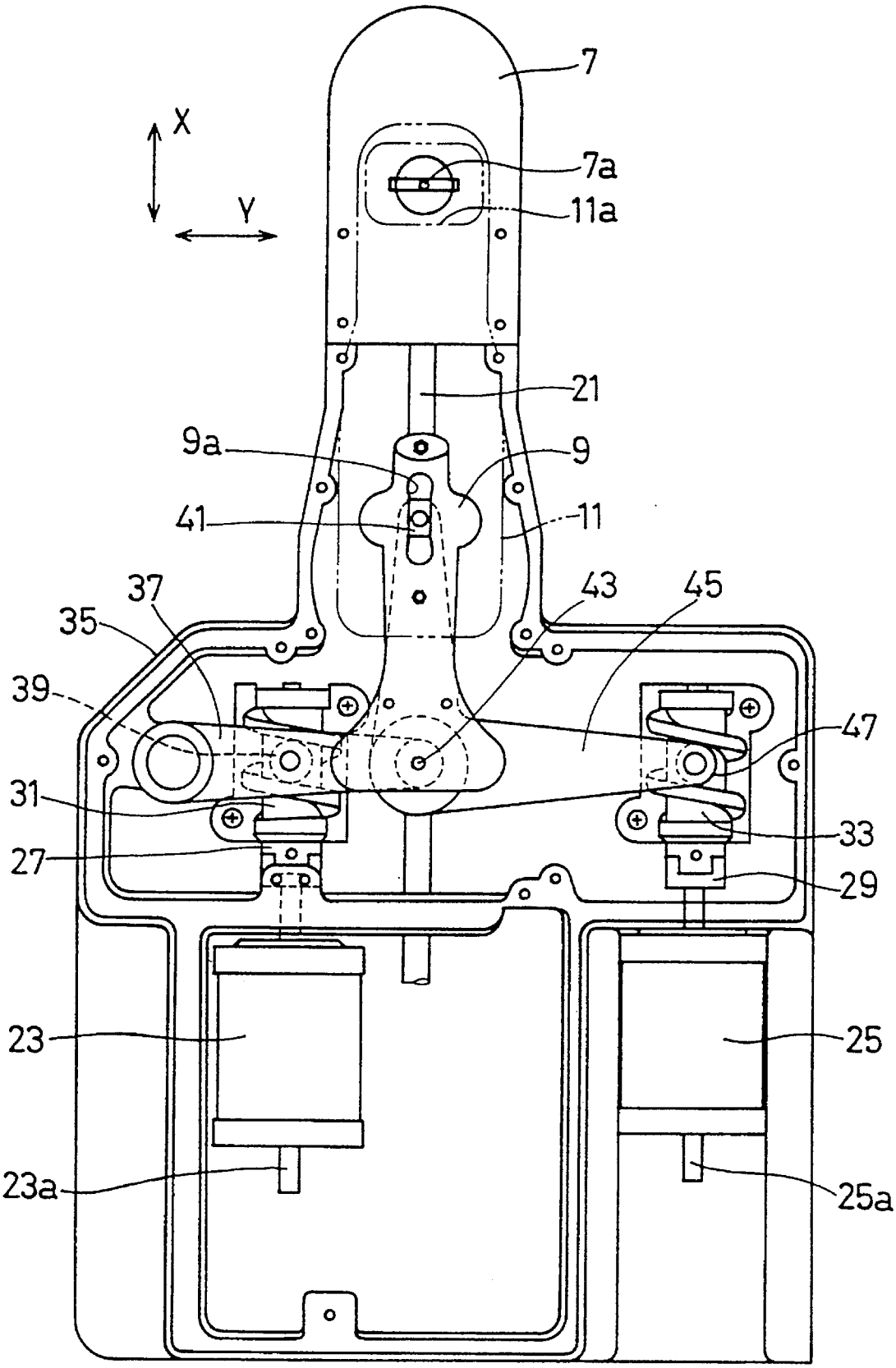
FIG. 2 is a plan view of an internal construction of the sewing machine of FIG. 1.

FIG. 2 shows an inner construction of the sewing bed 3. The sewing bed 1 has a lower shaft 21 whose base portion (not shown) is connected to a main drive source (not shown), and a pair of pulse motors 23, 25 are provided on both sides of the lower shaft 21 such that respective drive shafts 23*a*, 25*a* of the pulse motors 23, 25 extend parallel to each other, parallel to the lower shaft 21, and parallel to the cover plate 5 and throat plate 7, i.e., top surface of the sewing bed 3. The first and second motor shafts 23*a*, 25*a* are connected to a first and a second cylindrical cam 31, 33 via a first and a second coupling 27, 29, respectively. Thus, when the first motor 23 is driven and the first shaft 23*a* is rotated, the first cam 31 is rotated about a first axis line parallel to the top surface of the sewing bed 3 and, when the second motor 25 is driven and the second shaft 25*a* is rotated, the second cam 33 is rotated about a second axis line parallel to the first axis line and the top surface of the sewing bed 3. Each of the cylindrical cams 31, 33 has, on an outer circumferential surface thereof, a spiral ridge defining a spiral groove which has a constant width over an entire length thereof.

A linear lever 37 is provided between a housing 35 of the sewing bed 3 and the feed table 9, such that the linear lever 37 is rotatable about an axis member fixed to the housing 35 and is rotatable about an axis member 43 fixed to the feed table 9. A first cam follower in the form of a roller device 39 is fixed to an intermediate portion of the linear lever 37. The first roller device 39 includes an axis member fixed to the lever 37, and a cylindrical roller member rotatable about the axis member relative to the lever 37. The roller member 39 has an outer diameter slightly smaller than the width of the groove of the first cam 31 and is engaged with the cam groove. The feed table 9 has, in a front end portion thereof, an elongate hole 9*a* which is formed through the thickness of the feed table 9 and has a constant width in a longitudinal direction thereof, and a rotary block 41 is fit in the elongate hole 9*a* such that the rotary block 41 is movable or slideable relative to the elongate hole 9*a* or feed table 9. The rotary block 41 is connected to a first arm of an L-shaped lever 45 via an axis member such that the block 41 is rotatable relative to the lever 45 about the axis member. The L-shaped lever 45 is rotatable about an axis member 46 (FIG. 3) fixed to the housing 35.

Figure 3:
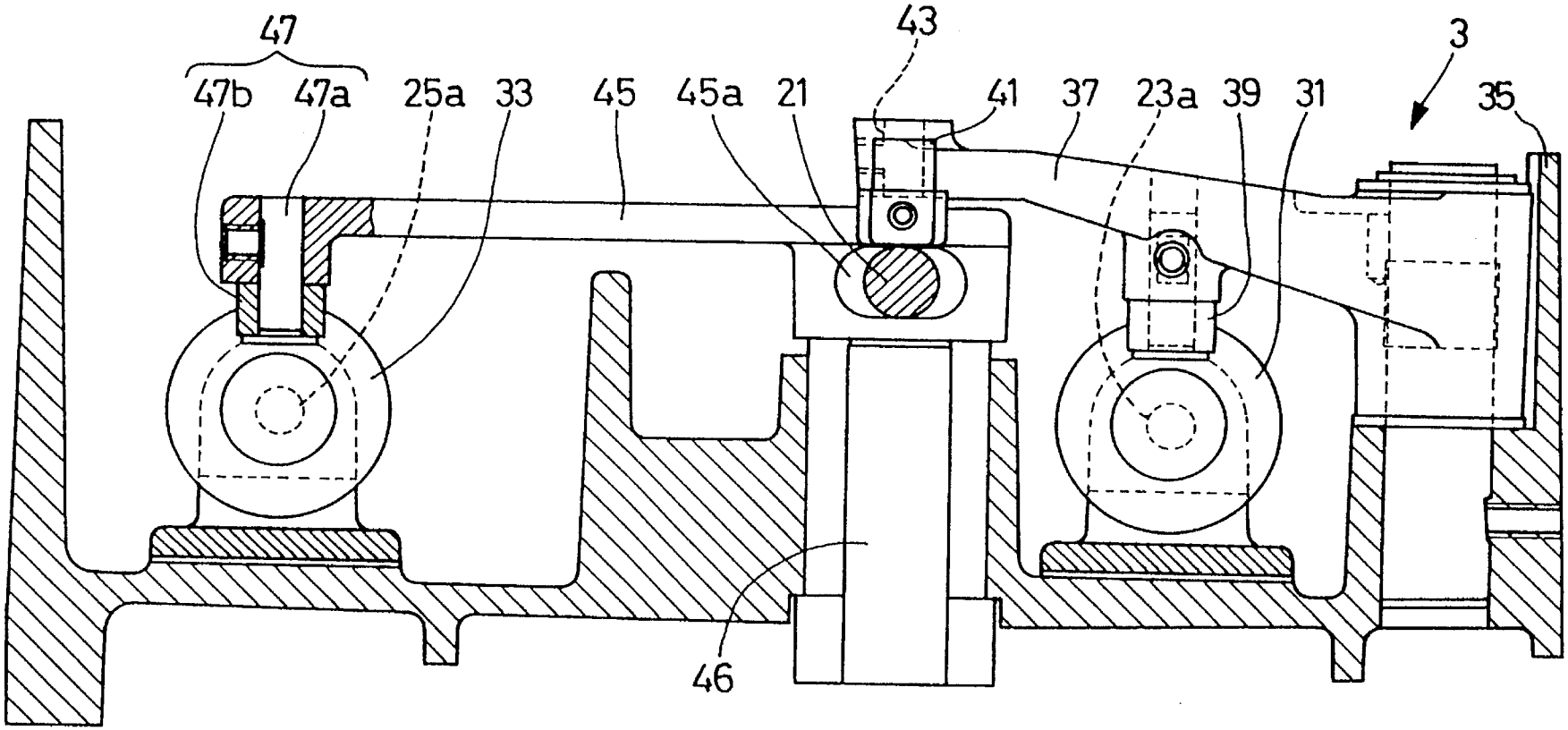
FIG. 3 is a transverse cross-section view of an internal construction of a sewing bed of the sewing machine of FIG. 1.

FIG. 3 also shows the inner construction of the sewing bed 3. In this figure, the two cams 31, 33 are illustrated in a simplified fashion. A second cam follower in the form of a second roller device 47 is fixed to a second arm of the L-shaped lever 45. The roller device 47 includes an axis member 47*a* and a cylindrical roller member 47*b* rotatable about the axis member 47*a* relative to the lever 45. The roller member 47*b* has an outer diameter slightly smaller than the width of the groove of the second cam 33 and is engaged with the cam groove. The axis member 47*a* extends from the second arm of the L-shaped lever 45 toward the rotation axis line of the second cam 33.

The L-shaped lever 45 has an elongate hole 45*a* in an intermediate portion thereof connected to the axis member 46, such that the lower shaft 21 extends through the elongate hole 45*a*. Since the elongate hole 45*a* has a length greater than the diameter of the lower shaft 21, the L-shaped lever 45 is rotatable about the axis member 46 within a predetermined angular range corresponding to the length of the hole 45*a*.

Next, there will be described the operation of the sewing machine 1 constructed as described above. When the first and/or second pulse motor 23, 25 are/is driven, the feed plate 11 is moved in the following manner, so that the work sheet or sheets held between the quadrangular frame 11*a* and the pressing arm 13 is/are moved over the throat plate 7:

When the first pulse motor 23 is driven, the first cam 31 is rotated and accordingly the first roller 39 is moved substantially along the rotation axis line of the cam 31 parallel to the first drive shaft 23*a* of the pulse motor 23, i.e., in an X direction indicated at arrow in FIG. 2. The axis member 43 is also moved in the X direction and accordingly the feed table 9 and the feed plate 11 are moved in the X direction. In this event, the elongate hole 9*a* and the rotary block 41 cooperate with each other to provide a guide device for guiding the feed table 9 and feed plate 11 in the X direction. Meanwhile, when the second pulse motor 25 is driven, the second cam 33 is rotated and accordingly the second roller 47 is moved substantially along the rotation axis line of the cam 33 parallel to the second drive shaft 25*a* of the pulse motor 25, i.e., in the X direction. The L-shaped lever 45 is rotated about the axis member 46, so that the feed table 9 and the feed plate 11 are moved via the rotary block 41 and the elongate hole 9*a*, in a Y direction perpendicular to the X direction and indicated at arrow in FIG. 2. The X and Y directions are parallel to the top surface of the sewing bed 3. Thus, the feed table 9 and the feed plate 11 are moved in the Y direction. Therefore, when the first and/or second motors 23, 25 are/is driven, the feed plate 11 is movable to any location on a horizontal plane defined by the X and Y directions.

In the present embodiment, the feed table 9, linear lever 37, L-shaped lever 45, and others cooperate with one another to provide a moving device for moving, relative to a sewing needle (not shown) held by the sewing arm 15, the feed plate 11 (quadrangular frame 11*a*) and the pressing arm 13 which cooperate with each other to provide a sheet holding device for holding one or more work sheets (not shown). The sewing arm 15 provides a needle holding device for holding the sewing needle. The two pulse motors 23, 25 provide a drive source.

Since in the present embodiment the cylindrical cams 31, 33 and the cam followers 39, 47 are employed, the rotation speeds of the drive shafts 23*a*, 25*a* of the pulse motors 23, 25 are largely reduced. Thus, the present sewing machine 1 enjoys a great reduction speed ratio. The sewing machine 1 does not need a high-power motor or motors which output a high power or torque, or does not increase the inertia of the moving device for moving the sheet holding device. Since the cylindrical cams 31, 33 and the cam followers 39, 47 are very simple, the moving device can be produced at low cost.

In addition, since the respective drive shafts 23*a*, 25*a* of the drive motors 23, 25 and the respective axis lines of the cylindrical cams 31, 33 are parallel to the top surface of the sewing bed 3, the moving device for moving the sheet holding device can be provided in a small, flat space under the sewing bed 3, as shown in FIG. 1. This structural feature enables a number of sewing machines 1 (only one is shown in FIG. 1) to be used in an array on a common table provided in a sewing factory.

Moreover, since the two drive shafts 23*a*, 25*a* of the two motors 23, 25 are parallel to each other, the moving device can be accommodated in a smaller or compacter space. Consequently the sewing machine 1 can be produced in a smaller size.

Furthermore, the roller devices 39, 47 produce substantially no friction when moving on the side-wall surfaces of the spiral grooves of the cylindrical cams 31, 33. Therefore, the feed plate 11 can be moved with accuracy and the durability of the moving device is improved.

Figure 4:
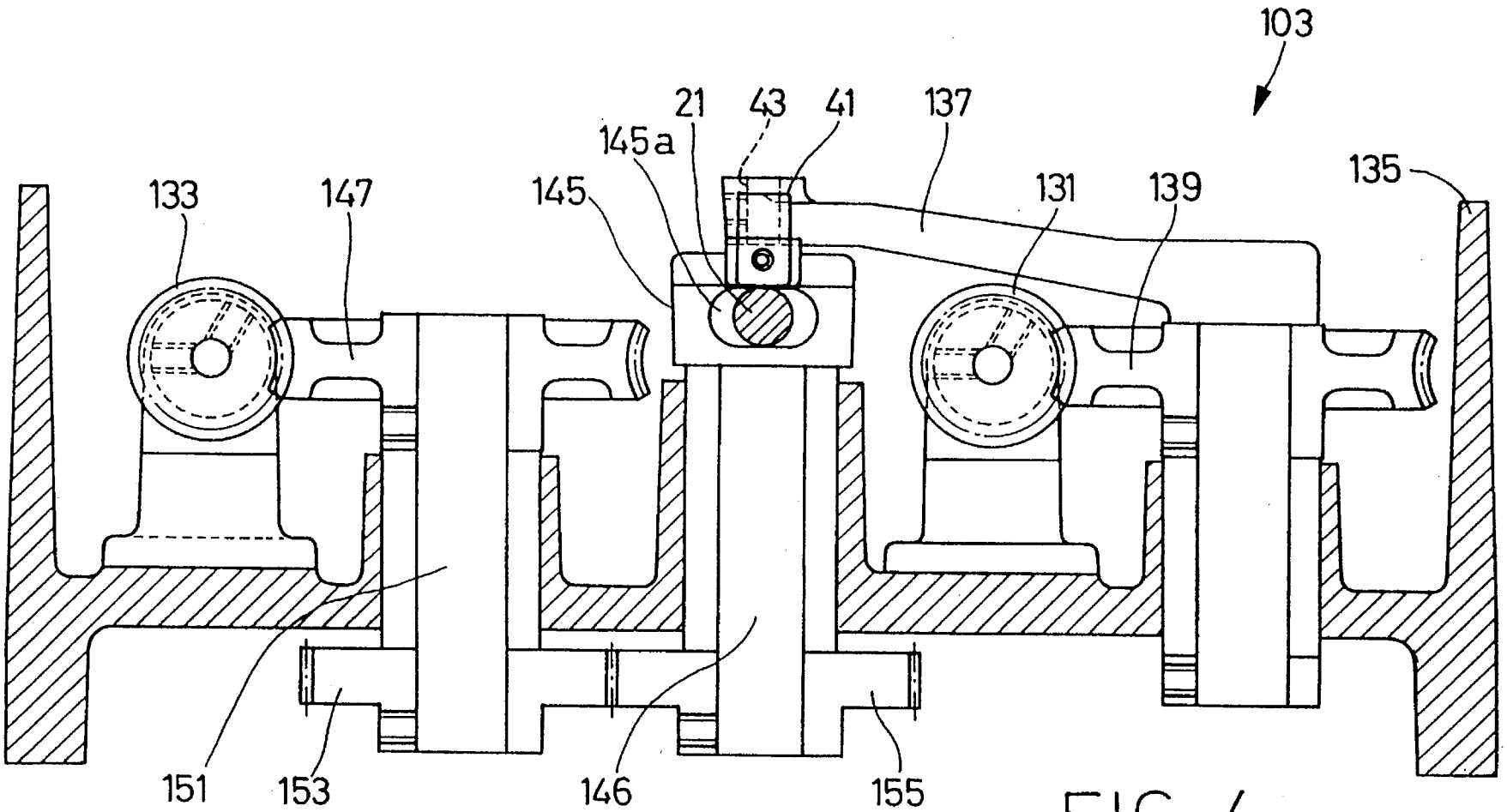
FIG. 4 is a transverse cross-section view of an internal construction of a sewing bed of another sewing machine as a second embodiment of the invention.

Referring next to FIG. 4, there is shown a sewing machine 103 as a second embodiment of the invention. The second sewing machine 103 has the same lower shaft 21, rotary block 41, and axis member 43 as the counterparts of the first sewing machine shown in FIG. 3. The second sewing machine 103 has a first worm and worm wheel 131, 139 and a second worm and worm wheel 133, 147, in place of the first cam and cam follower 31, 39 and the second cam and cam follower 33, 47 of the first sewing machine.

The first worm 131 is fixed to a first drive shaft 23*a* of a first pulse motor 23, and a first worm wheel 139 is threadedly engaged with the first worm 131. A first linear lever 137 is fixed to the first worm wheel 139, so that the first lever 137 is rotatable together with the first wheel 139. The first lever 137 is connected, at one end thereof, to a rear portion of a feed table 9 via an axis member 43. A rotary block 41 is fit in an elongate hole 9*a* formed in a front portion of the feed table 9, and is connected to a front portion of a second linear lever 145 via an axis member such that the rotary block 41 is rotatable relative to the second lever 145 about the axis member. The second lever 145 extends along a lower shaft 21. When the first motor 23 is driven, the feed table 9 is moved in an X direction perpendicular to the sheet of FIG. 4.

The second worm 133 is fixed to a second drive shaft 25*a* of a second pulse motor 25, and a second worm wheel 147 is threadedly engaged with the second worm 133. The second worm wheel 147 is fixed via an axis member 151 to a first spur gear 153 provided under a bottom wall of a housing 135 of a sewing bed 3. The first spur gear 153 is threadedly engaged with a second spur gear 155 which is fixed to an axis member 146 about which the second lever 145 is rotatable. The second lever 145 has an elongate hole 145*a* through which the lower shaft 21 extends. The elongate hole 145*a* enables the second lever 145 to be rotated about the axis member 146 within a predetermined angular range corresponding to the length of the elongate hole 145*a*. When the second motor 25 is driven, the rotary block 41 connected to the front end portion of the second lever 145 is moved in a Y direction perpendicular to the X direction. Each worm wheel 139, 147 has a predetermined friction coefficient.

Like in the first embodiment, when the first and/or second motor 23, 25 are/is driven, a feed plate 11 is moved to any position on a horizontal plane defined by the X and Y directions. In the second embodiment, the worms 131, 133 provide driving members each having a spiral groove, and the worm wheels 139, 147 provide driven members each of which has projections in the form of teeth engaged with the spiral groove of a corresponding driving member.

In the second embodiment, the combination of the worm 131, 133 and the worm wheel 139, 147 effectively accommodates the motion of the feed plate 11 due to the inertia thereof upon starting, stopping, or direction-changing thereof, and does not transmit that motion to the drive source 23, 25. Accordingly, the moving device can move the sheet holding device at high speeds, and the sheet holding device can follow the high rotation speeds of the motors 23, 25. To this end, the second sewing machine 103 does not need a large-size motor which outputs a high power. In addition, the combination of the worms 131, 133 and worm wheels 139, 147 is very simple. Thus, the second sewing machine can be produced at low cost and in a small size.

In the second embodiment, the two pulse motors 23, 25 may be provided such that the two drive shafts 23*a*, 25*a* extend vertically. In the latter case, an appropriate transmitting device such as levers is used to connect each drive shaft 23*a*, 25*a* and the sheet holding device 11, 13. In either case, the sewing machine can enjoy a high capability to follow the high rotation speeds of the drive motors 23, 25.

Figure 5:
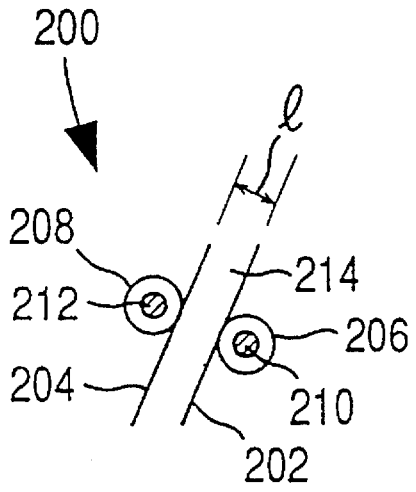
FIG. 5 is a view of a cam and a pair of cam followers employed in a third embodiment of the invention.

Referring next to FIG. 5, there is shown a third embodiment wherein a cylindrical cam 200 is employed in place of each of the first and second cams 31, 33 of the first embodiment shown in FIGS. 1 to 3. The cylindrical cam 200 has a spiral ridge 214 having a constant width, 1, over an entire length thereof (only a portion of the ridge 214 is shown). A cam follower in the form of a pair of cylindrical roller members 206, 208 are engaged with a pair of side surfaces of the spiral ridge 214, respectively. The roller members 206, 208 are rotatable about axis members 210, 212, respectively, and are movable on the side surfaces of the ridge 214, when the cam 200 is rotated by the first or second pulse motor 23, 25. The axis members 210, 212 are fixed to the first or second lever 37, 45. The two roller members 206, 208 are biased toward each other to pinch the ridge 214, by a biasing device (not shown). Thus, the two roller members 206, 208 provide a "negative-clearance" cam follower. The width of the spiral ridge 214 may not be constant, i.e., may vary over the length thereof. The roller members 206, 208 produce substantially no friction on the side surfaces of the ridge 214 when the cam 200 is rotated.

Figure 6:
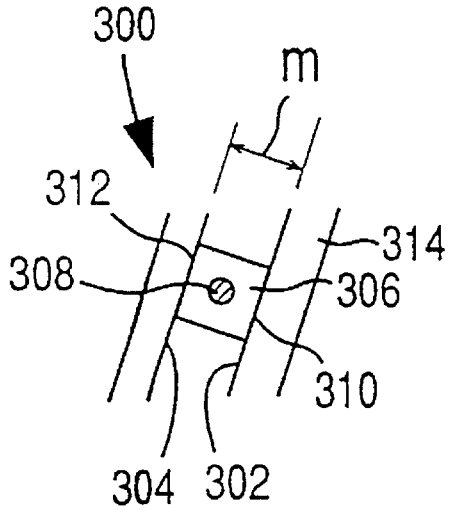
FIG. 6 is a view of a cam and a cam follower employed in a fourth embodiment of the invention.

Referring next to FIG. 6, there is shown a fourth embodiment wherein a cylindrical cam 300 is employed in place of each of the first and second cams 31, 33 of the first embodiment shown in FIGS. 1 to 3, or in place of each of the first and second worms 131, 133 of the second embodiment shown in FIG. 4. In the case where the two cams 300 are used in place of the two worms 131, 133 of the second embodiment, the worm wheels 139, 147, the linear levers 137, 145, and the spur gears 151, 155 employed in the second embodiment may be replaced by the cam followers 39, 47 and the linear and L-shaped levers 37, 45 of the first embodiment. The cylindrical cam 300 has a spiral ridge 314 defining a spiral groove having a constant width, m, over an entire length thereof (only a portion of the groove is shown). A cam follower in the form of a rotary block 306 has a pair of opposite side surfaces 310, 312 which are held in slideable contact with a pair of side-wall surfaces 302, 304 of the spiral groove defined by the ridge 314, respectively. The rotary block 306 is rotatable about an axis member 308 and is slideable on the side-wall surfaces 302, 304 of the cam groove, when the cam 300 is rotated by the first or second pulse motor 23, 25. The axis member 308 is fixed to the first or second lever 37, 45. The side surfaces 310, 312 of the rotary block 306 have predetermined friction coefficients which ensure that when the sheet holding device is started, stopped, or direction-changed, any motion of the sheet holding device is not transmitted to the drive source 23, 25 because of the friction produced between the rotary block 306 and the cam 300. Thus, the fourth embodiment enjoys the combined advantages of both the first and second embodiments.

In each of the illustrated embodiments, the pulse motors 23, 25 may be replaced by other sorts of drive sources.

In each of the illustrated embodiments, the feed plate 11 is moved, in fact, along an arc as the locus of rotation of the feed table 9 about the axis member 46, when the second pulse motor 25 is driven. It can however be said that the feed plate 11 is moved along a straight line approximated by that arc. Similarly, the feed table 9 is moved, in fact, along an arc as the locus of rotation of the linear lever 37, when the first pulse motor 23 is driven, but it can be said that the feed table 9 is moved along a straight line approximated by the second arc. It goes without saying that it is possible to employ such a moving device which moves the feed plate 11 accurately along a first straight line and along a second straight line perpendicular to the first straight line.

It is to be understood that the present invention may be embodied with other changes, improvements, and modifications that may occur to those skilled in the art without departing from the scope and spirit of the invention defined in the appended claims.

What is claimed is:

1. A sewing machine comprising:

a needle holding device which holds a sewing needle;

a sheet holding device which holds at least one work sheet; and a moving device which moves said sheet holding device relative to said needle holding device, said moving device including a drive source which produces a drive force, at least one cylindrical cam which is connected to said drive source and is rotatable about an axis line by being driven by the drive source, said cylindrical cam having a pair of opposite spiral cam surfaces formed on an outer circumferential surface thereof, and at least one cam follower which is connected to said sheet holding device and is engaged with said spiral cam surfaces of said cylindrical cam such that said cam follower is movable along the cam surfaces and is substantially immovable in directions perpendicular to the cam surfaces, said cam follower being moved in a drive-force transmitting direction substantially parallel to said axis line of the cylindrical cam when the cam is rotated by said drive source, so that the cam follower transmits the drive force of the drive source to the sheet holding device.

2. A sewing machine according to claim 1, wherein said cylindrical cam has a spiral groove which has a pair of opposite side-wall surfaces as said pair of opposite spiral cam surfaces and has a constant width over an entire length of said side-wall surfaces, and wherein said cam follower comprises a single roller which is rotatable about an axis line and is engaged with said spiral groove of said cam.

3. A sewing machine according to claim 1, wherein said cylindrical cam has a spiral ridge which has a pair of opposite side surfaces as said pair of opposite spiral cam surfaces and has a constant width over an entire length of said side surfaces, and wherein said cam follower comprises a pair of rollers each of which is rotatable about an axis line and which are engaged with said spiral ridge of said cam.

4. A sewing machine according to claim 1, wherein said cylindrical cam has a spiral groove which has a pair of opposite side-wall surfaces as said pair of opposite spiral cam surfaces and has a constant width over an entire length of said side-wall surfaces, and wherein said cam follower comprises a single block having a pair of opposite side surfaces which are held in slideable contact with the two side-wall surfaces of said spiral groove, respectively, and have a predetermined friction coefficient.

5. A sewing machine according to claim 1, further comprising a sewing bed, wherein said at least one cam comprises a first and a second cam, said at least one cam follower comprises a first and a second cam follower which are engaged with said first and second cams, respectively, and said drive source comprises a first and a second motor having a first and a second drive shaft, respectively, each of which is rotatable to produce said drive force and to which said first and second cams are coaxially connected, respectively, said first motor, said first cam, and said first cam follower cooperating with one another to move said sheet holding device in a first direction parallel to a surface of said sewing bed, said second motor, said second cam, and said second cam follower cooperating with one another to move the sheet holding device in a second direction parallel to said surface of the sewing bed and perpendicular to said first direction, said first and second drive shafts of the first and second motors extending parallel to said surface of the sewing bed.

6. A sewing machine according to claim 5, wherein said first and second motors have said first and second drive shafts extending parallel to each other.

7. A sewing machine according to claim 1, wherein said sheet holding device comprises a holder member which holds said work sheet, said at least one cam comprises a first and a second cam, and said at least one cam follower comprises a first and a second cam follower, and wherein said moving device further comprises:

a feed member which feeds said holder member in a first and a second direction substantially perpendicular to each other;

a first lever which is rotatable about a first vertical axis line and is connected to a first portion of said feed member such that said first lever is rotatable relative to the feed member about said first axis line thereof, the first lever extending substantially parallel to said second direction, said first cam follower being connected to said first lever so that when said first cam is rotated said feed member is moved in said first direction; and a second lever which is rotatable about a second vertical axis line and is connected to a second portion of said feed member remote from said first portion thereof, such that said second lever is rotatable relative to the feed member about said second axis line thereof, the second lever extending substantially parallel to said first direction, said second cam follower being connected to said second lever so that when said second cam is rotated said feed member is moved in said second direction.

8. A sewing machine according to claim 7, wherein said first lever comprises a linear lever including three different portions one of which is rotatable about said first axis line of the first lever and two of which are connected to said first portion of said feed member and said first cam follower, respectively, and wherein said second lever comprises an L-shaped lever having three different portions an intermediate one of which is rotatable about said second axis line of the second lever and two of which are connected to said second portion of said feed member and said second cam follower, respectively, said drive device comprising a first and a second motor having a first and a second drive shaft, respectively, which extend parallel to each other and parallel to a horizontal surface of a sewing bed, said first and second cams being coaxially connected to said first and second drive shafts of said first and second motors, respectively.

9. A sewing machine according to claim 7, wherein said moving device comprises:

a rotary block which is connected to one of (a) one of said first and second levers and (b) a corresponding one of said first and second portions of said feed member, such that said rotary block is rotatable about a vertical axis line thereof; and an elongate hole which is formed in the other of (a) said one of said first and second levers and (b) said corresponding one of said first and second portions of said feed member and which has a constant width in a longitudinal direction thereof, said rotary block being fit in said elongate hole such that the rotary block and the elongate hole are movable relative to each other.

10. A sewing machine according to claim 7, wherein at least one of said first and second cam followers comprises at least one cam follower selected from the group consisting of (a) a single roller which is rotatable about an axis line and which is engaged with a pair of opposite side-wall surfaces of a spiral groove of at least one of said first and second cams, (b) a pair of rollers each of which is rotatable about an axis line and which are engaged with a pair of opposite side surfaces of a spiral ridge of at least one of said first and second cams, respectively, and (c) a single block having a pair of opposite side surfaces which are held in slideable contact with a pair of opposite side-wall surfaces of a spiral groove of at least one of said first and second cams and have a predetermined friction coefficient.

11. A sewing machine comprising:

a needle holding device which holds a sewing needle;

a sheet holding device which holds at least one work sheet; and a moving device which moves said sheet holding device relative to said needle holding device, said moving device including:

a drive source which produces a drive force and comprises a drive shaft which is rotatable to produce said drive force, and a one-way transmitting mechanism which transmits the drive force of said drive source to said sheet holding device and does not transmit a motion of said sheet holding device to said drive source, said one-way transmitting mechanism comprising:

at least one driving member fixed to said drive shaft of said drive source so that said driving member is rotatable with said drive shaft;

at least one driven member which is engaged with said driving member such that when said driving member is rotated with said drive shaft, said driving and driven members are moved relative to each other in a transmitting direction substantially parallel to said drive shaft of said source and, when said driving member is not rotated, said driving and driven members are not moved relative to each other in said transmitting direction; and a movement transmitting device which transmits the movement of said driven member relative to said driving member in said transmitting direction, to said sheet holding device.

12. A sewing machine according to claim 11, further comprising a sewing bed, wherein said moving device moves said sheet holding device in a direction parallel to a surface of said sewing bed.

13. A sewing machine according to claim 11, further comprising a sewing bed, wherein said drive source comprises a motor having a drive shaft extending parallel to a surface of said sewing bed.

14. A sewing machine according to claim 11, wherein said driving member comprises one of a spiral groove and at least one projection engaged with the spiral groove, and said driven member comprises the other of said spiral groove and said projection.

15. A sewing machine according to claim 14, wherein said driving member comprises a worm having said spiral groove and said driven member comprises a worm wheel having, as said at least one projection, a plurality of teeth engaged with the spiral groove of said worm.

16. A sewing machine according to claim 14, wherein said driving member comprises a cylindrical cam having said spiral groove formed in an outer circumferential surface thereof, and said driven member comprises a movable block having a pair of opposite side surfaces which are held in slideable contact with a pair of opposite side-wall surfaces of the spiral groove of said cam and have a predetermined friction coefficient.

17. A sewing machine according to claim 11, wherein said sheet holding device comprises a holder member which holds said work sheet, said at least one driving member comprises a first and a second driving member, and said at least one driven member comprises a first and a second driven member, and wherein said moving device further comprises:

a feed member which feeds said holder member in a first and a second direction substantially perpendicular to each other;

a first lever which is rotatable about an axis line and is connected to a first portion of said feed member such that said first lever is rotatable relative to the feed member, the first lever extending substantially parallel to said second direction, said first driven member being connected to said first lever so that when said first driving member is rotated said feed member is moved in said first direction; and a second lever which is rotatable about an axis line and is connected to a second portion of said feed member remote from said first portion thereof, such that said second lever is rotatable relative to the feed member, the second lever extending substantially parallel to said first direction, said second driven member being connected to said second lever so that when said second driving member is rotated said feed member is moved in said second direction.

18. A sewing machine comprising:

a needle holding device which holds a sewing needle;

a sheet holding device which holds at least one work sheet; and a moving device which moves said sheet holding device relative to said needle holding device, said moving device including:

a drive source which produces a drive force and comprises a drive shaft which is rotatable to produce said drive force, and a one-way transmitting mechanism which transmits the drive force of said drive source to said sheet holding device and does not transmit a motion of said sheet holding device to said drive source, said one-way transmitting mechanism comprising:

at least one driving member fixed to said drive shaft of said drive source so that said driving member is rotatable with said drive shaft;

at least one driven member;

means for engaging said driven member with said driving member such that said driving and driven members are movable relative to each other in a transmitting direction substantially parallel to said drive shaft of said drive source; and a movement transmitting device which transmits the movement of said driven member relative to said driving member in said transmitting direction, to said sheet holding device.

* * * * *